US009303449B2

(12) United States Patent
Balay et al.

(10) Patent No.: US 9,303,449 B2
(45) Date of Patent: Apr. 5, 2016

(54) OVERHEAD COILING CLOSURE HOOD GUARD

(71) Applicant: CIW Enterprises, Inc., Mountaintop, PA (US)

(72) Inventors: Thomas Balay, Drums, PA (US); Joseph D. Kondash, Wilkes-Barre, PA (US); Joseph Balay, Sugarloaf, PA (US); Ian Klish, Nanticoke, PA (US)

(73) Assignee: CIW Enterprises, Inc., Mountaintop, PA (US)

( * ) Notice: Subject to any disclaimer, the term of this patent is extended or adjusted under 35 U.S.C. 154(b) by 0 days.

(21) Appl. No.: 14/187,235

(22) Filed: Feb. 22, 2014

(65) Prior Publication Data

US 2015/0240557 A1 Aug. 27, 2015

(51) Int. Cl.

| | |
|---|---|
| ***E06B 9/56*** | (2006.01) |
| ***E06B 9/17*** | (2006.01) |
| ***E06B 7/28*** | (2006.01) |

(52) U.S. Cl.

CPC ... *E06B 9/17* (2013.01); *E06B 7/28* (2013.01); *E06B 9/56* (2013.01)

(58) Field of Classification Search

CPC ..... E06B 9/15; E06B 9/165; E06B 9/34; E06B 9/58; E06B 9/581; E06B 9/17; E06B 9/56; E06B 7/28; B60R 19/28

USPC ..... 160/23.1, 133; 248/254; 242/615; 211/105.1

See application file for complete search history.

(56) References Cited

U.S. PATENT DOCUMENTS

| | | | | | |
|---|---|---|---|---|---|
| 1,003,015 | A * | 9/1911 | Thomas | 293/137 |
| 1,450,449 | A * | 4/1923 | Pelosi | 293/137 |
| 2,186,137 | A * | 1/1940 | Halladay | 293/137 |
| 3,746,384 | A * | 7/1973 | Ripley | 293/137 |
| 6,659,158 | B2 * | 12/2003 | Laugenbach | 160/270 |
| 7,891,401 | B2 * | 2/2011 | Decola | 160/264 |
| 2009/0183842 | A1 * | 7/2009 | DeCola | 160/209 |

* cited by examiner

*Primary Examiner* — Blair M Johnson
(74) *Attorney, Agent, or Firm* — Mitchell A. Smolow

(57) ABSTRACT

The disclosed invention prevents damage to a hood and its contents. In a preferred embodiment, a first and second support member are mounted on either side of an access opening. A cross member is slidably retained in a protective, starting position within the support members. The cross member is preferably positioned above the access opening in front of a coiling door hood such that a striking force directed at the hood first encounters the cross member. When struck, the cross member slidably retracts against a force assembly to dissipate the striking force and upon withdrawal of the striking force the cross member returns without human intervention to the protective, starting position.

16 Claims, 3 Drawing Sheets

OVERHEAD COILING CLOSURE HOOD GUARD

FIELD OF THE INVENTION

This invention relates generally to impact protection for overhead closures and in particular, to an overhead coiling door hood guard.

BACKGROUND OF THE INVENTION

Access openings in warehouse, manufacturing and industrial settings are often secured by overhead (vertically traveling) closures.

Overhead coiling closures are, for example, slatted doors, such as rolling steel doors, which move in a generally vertical path coiling above the opening as the door is opened. Because overhead coiling closures have many fewer parts than sectional doors with less risk for damage and inoperability they often make a better solution for facilities that cannot afford opening downtime.

An overhead coiling closure is either provided with a powered operator to power the door to an open or closed position or it is manually opened and closed with, for example, a looped chain or crank. A shaft is horizontally mounted above the access opening to wind or unwind the coiling closure. The coiling shaft and operator (if present) are usually covered by a hood.

When doors are installed in high traffic areas, for example, shipping and receiving areas the hood and its contents can get damaged if struck by a fork lift transporting cargo. This damage can be caused not only by the forklift itself, but also by the cargo being trucked by the lift. If the hood or its contents become damaged the coiling closure may become non-operational with resultant access opening downtime.

Accordingly, there is still a continuing need for improved designs to protect a coiling closure hood and its contents. The present invention fulfills this need and further provides related advantages.

BRIEF SUMMARY OF THE INVENTION

The disclosed invention prevents damage to a hood and its contents. For example, where the driver of a forklift is slowly traversing an access opening or simply testing passage of the opening by traversing slowly, the invention will absorb the force of a strike and automatically return to a protective position without requiring maintenance.

In a preferred embodiment, a first and second support member are mounted on either side of an access opening. A cross member is slidably retained in a protective, starting position within the support members. The cross member is preferably positioned above the access opening in front of a coiling door hood such that a striking force directed at the hood first encounters the cross member. When struck, the cross member slidably retracts against a force assembly to dissipate the striking force and upon withdrawal of the striking force the cross member returns without human intervention to the protective, starting position.

One advantage of the present invention is the reduction in access opening downtime due to damage of the overhead coiling closure from directed force strikes.

A second advantage is the automatic resetting to the protective, starting position obviating the need to restrict use of the access opening during a manual reset.

Other features and advantages of the present invention will be apparent from the following more detailed description of the preferred embodiments, taken in conjunction with the accompanying drawings which illustrate, by way of example, the principles of the invention.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

Figure 1:
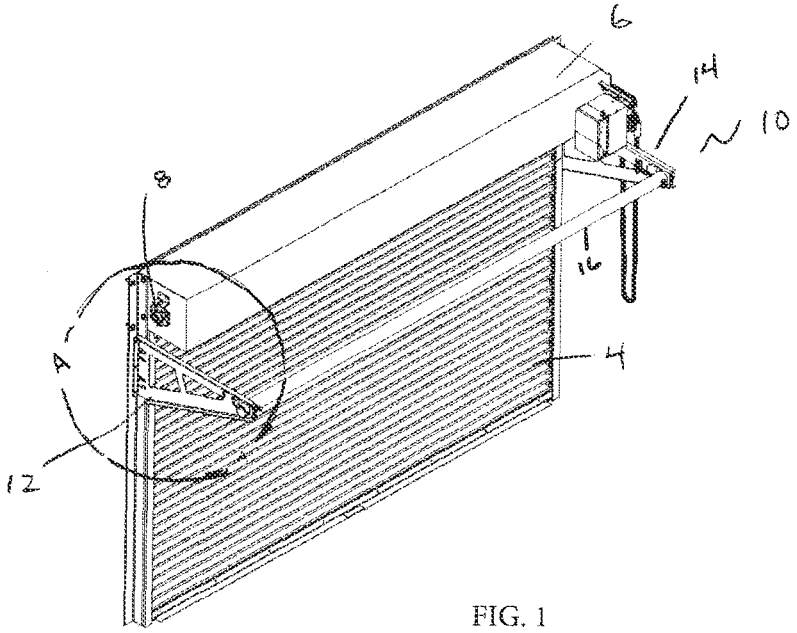
FIG. 1 is a perspective view of the hood guard mounted to an access opening.

Other features and advantages of the present invention will be apparent from the following more detailed description of the preferred embodiments, taken in conjunction with the accompanying drawings which illustrate, by way of example, the principles of the invention.

DETAILED DESCRIPTION OF THE INVENTION

As required, detailed embodiments of the present invention are disclosed; however, it is to be understood that the disclosed embodiments are merely exemplary of the invention that may be embodied in various forms. The figures are not necessary to scale, and some features may be exaggerated to show details of particular components. Therefore, specific structural and functional details disclosed are not to be interpreted as limiting, but merely as a basis for the claims and as a representative basis for teaching one skilled in the art to variously employ the present invention. Where possible, like reference numerals have been used to refer to like parts in the several alternative embodiments of the present invention described herein.

Turning to FIG. 1, conventional overhead coiling closure 4 is wound and unwound unto a coiling shaft 8 protected by a hood 6. The hood guard 10 of the present invention comprises a first and second support member, for example, first and second brackets 12, 14 which support a movable cross member, for example, cross bar 16.

Figure 2:
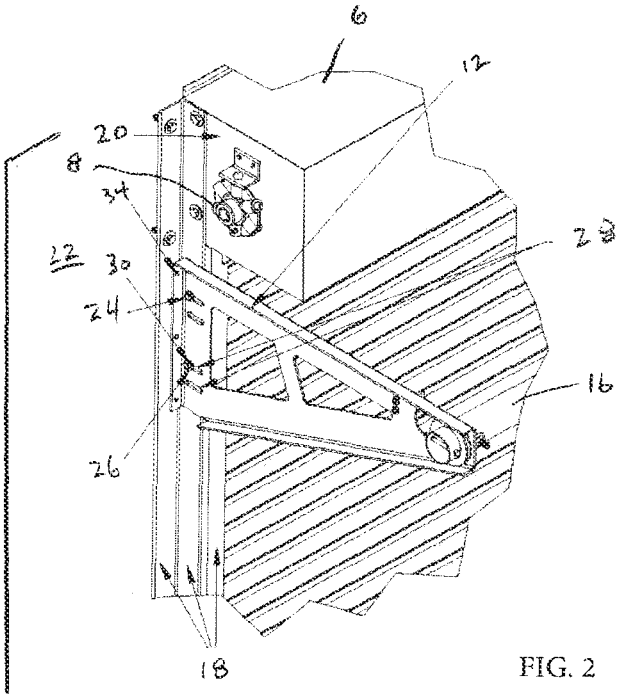
FIG. 2 is an enlarged perspective view of the support member contained with circle A of FIG. 1.

FIG. 2 depicts an enlarged view of the first support bracket 12 contained within circle A of FIG. 1. Coil bracket 20 (FIG. 2) mounts the protective hood 6 to an adjacent coiling closure support structure, for example, a guide angle 18 while also supporting a coiling shaft 8. The second support bracket 14 is a mirror image of the first support bracket 12. The second support bracket 14 mounts and operates in the same manner as the first support bracket 12 and will not be separately described.

The guide angles 18 are conventionally mounted to the building structure 22, for example, mounted to the door jamb in conventional manner. The support bracket 12 is mounted (either as a new install or optionally retrofitted) to an adjacent coiling closure support structure, for example, a guide angle 18 to extend outward from the building structure 22. Ideally, the support bracket 12 is mounted as close as possible to the coil bracket 20 to keep the cross bar 16 above the access opening while still guarding the hood 6.

Ideally the support bracket 12 is mounted directly against and fastened to the guide angle 18, for example, by using fasteners such as a self-tapping screw 24 or a bolt 26 inserted through a mounting slot 28 utilizing washers 30 and fastened with a nut 32. Wall mounting holes 34 provide for additional attachment points to mount the support bracket 12 using, for example, wall expansion bolts. Optionally, the support bracket 12 may be welded to the guide angle 18 against which the support bracket 12 rests.

It is important when using a self-tapping screw 24 not to tap into multiple guide angles 18 as this will inhibit the movement, for example, due to thermal expansion, of the guide angles 18 during a fire emergency. When the protective hood guard 10 is installed on a fire door, the installer must not inhibit the guide angles 18 by, for example, clamping them together with screws. The guide assembly fasteners pass through a slot that is effectively large enough to allow the expansion upward (guides pushing down on the floor) during extreme heat.

Figure 3A:
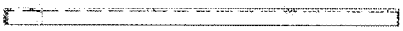
FIGS. 3*a* through 4 present various views of the support member.
Figure 3B:
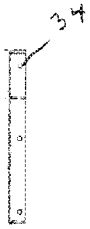
Figure 3C:
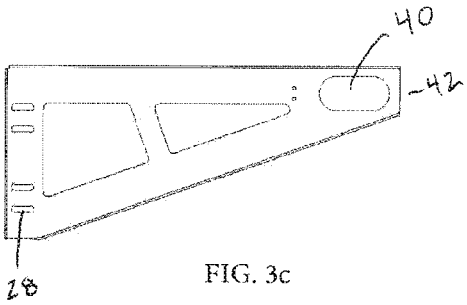
Figure 4:
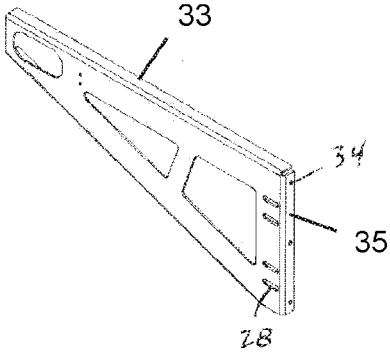

FIGS. 3*a*-4 depict various views of a mounting bracket 12, 14. The mounting bracket 12, 14 is designed and mounted to deflect, for example, horizontally, during operation as described further below. This deflection prevents the fasteners from shearing and keeps the hood guard 10 from rotating upward into the hood 6 or its contents. Preferably the mounting bracket 12, 14 is triangular to reduce the weight while maintaining strength. Preferably the height of the mounting bracket 12, 14 at its largest end is sized to mate to existing guide angle 18 fastener spacing so that the protective hood guard 10 does not require an adapter or special fastener spacing for installation. Although no adaptation is preferable, on retrofit applications adaptation may be required. Mounting bracket 12,14 comprises a top flange 33 and a mounting flange 35.

Figure 7:
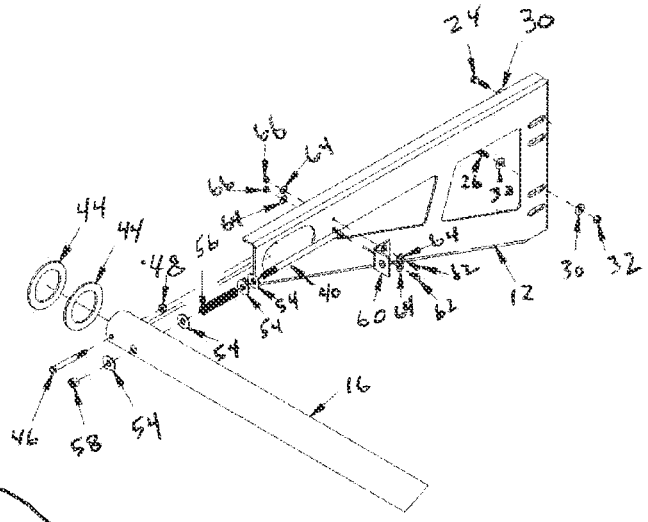
FIG. 7 is an enlarged exploded perspective view of the cross member and support member contained within circle B of FIG. 6.
Figure 6:
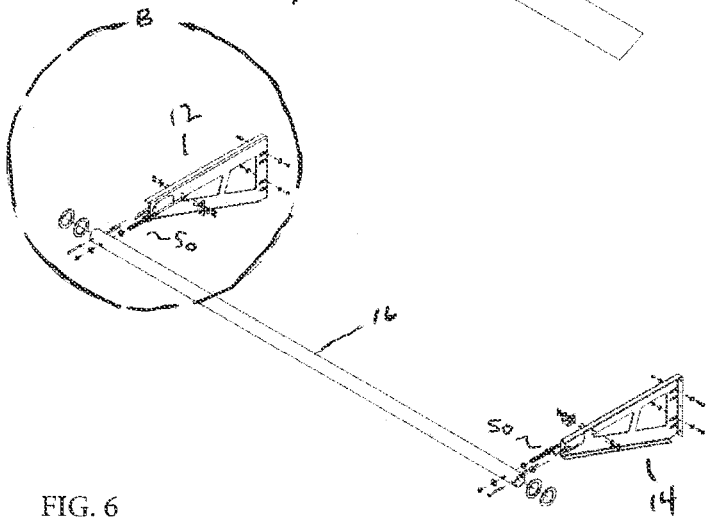
FIG. 6 is an exploded perspective view of the cross member and support members.

As depicted in FIGS. 6 and 7, cross bar 16 spans the access opening and slidably engages first and second support brackets 12, 14 in elongated slot 40 located at the support bracket outward end 42. It is held in a protective, starting position by a force assembly, for example, a spring assembly 50. The cross bar 16 is slidably retained in support brackets 12, 14 using, for example, pipe washers 44, an outer bolt 46 and nut 48, and an inner spring assembly 50. The pipe washers 44 provide an audible warning requiring no electrical wiring. They are loosely placed on the cross bar 16 to allow them to rattle when the cross bar 16 is struck.

Figure 5:
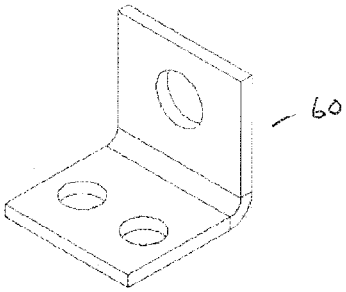
FIG. 5 is a perspective view of a spring clip angle.

The spring assembly 50 comprises a long bolt 52 which engages at a first end a spring clip angle 60, thereafter passing through a first set of spring washers 54, a spring 56, a second set of spring washers 54, and the cross bar 16 to engage a spring nut 58 as depicted in FIG. 7. Each spring clip angle 60 (FIG. 5) is fixed to its respective support member 12, 14 using, for example, spring clip angle bolts 62, washers 64, and nuts 66.

During operation, when the cross bar 16 is struck by a striking force the first and second support brackets 12, 14 deflect as the cross bar 16 slides rearward within the elongated slot 40, compressing the spring 56. When the striking force is removed the spring 56 releases to return the cross bar 16 to its protective, starting position. In this manner the hood 6 and its contents are protected from being damaged.

As the cross bar 16 is struck the spring assemblies 50 compress. As the cross bar 16 deflects there will be an imbalance left or right causing the support members 12, 14 to deflect left or right depending on the imbalance of the striking force. It is not required that all three happen for successful protection of the hood 6. The severity of the force impact is determinative.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. An overhead coiling closure hood guard comprising:

a movable cross member supported by a first horizontally deflectable and a second horizontally deflectable support member; wherein each of the horizontally deflectable support members comprise a top flange; and a force assembly connected to at least one of the first and second horizontally deflectable support members and operatively holding the cross member in a protective, starting position;

wherein the cross member slidably engages the first and second support members in an elongated slot located in outward ends of the first and second support members, respectively, and the force assembly comprises a spring assembly;

the spring assembly comprises a long bolt engaged at a first end thereof to a spring clip angle member mounted on the first or second support member, thereafter passing through a spring and the cross member to engage a spring nut; and upon receiving a cross member impact force the cross member deflects, the first and second support members horizontally deflect, and the first and second support members and the force assembly absorb the impact force.

2. The overhead coiling closure hood guard of claim 1 wherein the horizontally deflectable support member further comprises a mounting flange.

3. The overhead coiling closure hood guard of claim 1 further comprising a non-electrical audible warning member.

4. The overhead coiling closure hood guard of claim 3 wherein the non-electrical audible warning member comprises a pipe washer rattlingly placed on the cross member.

5. An overhead coiling closure comprising:

a coiling shaft encased within a protective hood;

a coiling closure operatively connected to the coiling shaft;

a first and second coiling closure support structure, one coiling closure support structure positioned on each side of the coiling closure;

a first horizontally deflectable and a second horizontally deflectable support member, each deflectably mounted to a respective one of the coiling closure support structures;

a movable cross member supported by the first horizontally deflectable and second horizontally deflectable support members; and a resilient force assembly connected to at least one of the first and second horizontally deflectable support members and operatively holding the cross member in a protective, starting position;

wherein upon receiving a cross member impact force the cross member deflects against the resilient force assembly and at least one of the first and second support members thereby absorbing the impact force.

6. The overhead coiling closure of claim 5 wherein the cross member slidably engages the first and second support members at an elongated slot located at a support member outward end and the force assembly comprises a spring assembly.

7. The overhead coiling closure of claim 6 wherein the spring assembly comprises a long bolt engaged at a first end therof to a spring clip angle mounted on the first or second support member, thereafter passing through a spring and the cross member to engage a spring nut.

8. The overhead coiling closure of claim 6 wherein the first and second coiling closure support structure are a respective first and second guide angle.

9. The overhead coiling closure of claim 7 wherein the first and second coiling closure support structure are a respective first and second guide angle.

10. The overhead coiling closure of claim 9 wherein the guide angle is additionally mounted to a wall.

11. The overhead coiling closure of claim 5 further comprising a non-electrical audible warning member.

12. The overhead coiling closure of claim 8 further comprising a non-electrical audible warning member.

13. The overhead coiling closure of claim 12 wherein the non-electrical audible warning member comprises a pipe washer rattlingly placed on the cross member.

14. A method of protecting an overhead coiling closure hood comprising the steps of:

deflectably mounting a first horizontally deflectable and a second horizontally deflectable support member to a respective coiling closure support structure;

mounting a movable cross member to the deflectable first and deflectable second support members; the deflectable support member comprising a force assembly operatively holding the cross member in a protective, starting position;

wherein the cross member slidably engages the first and second support members in an elongated slot located in an outward end of each support member and the force assembly comprises a spring assembly;

the spring assembly comprises a long bolt engaged at a first end thereof to a spring clip angle mounted on each of the first and second support members, thereafter passing through a spring and the cross member to engage a spring nut; and upon receiving a cross member impact force the cross member deflects and the first and second support members horizontally deflect, thereby absorbing the impact force.

15. The method of claim 14 further comprising a non-electrical audible warning member.

16. The method of claim 15 wherein the non-electrical audible warning member comprises a pipe washer rattlingly placed on the cross member.

* * * * *